US005830029A

United States Patent [19]

Siegel

[11] Patent Number: 5,830,029

[45] Date of Patent: Nov. 3, 1998

[54] TOY BOW-IN-ARROW BUBBLE SHOOTER SYSTEM

[76] Inventor: Richard Bryan Siegel, 735 Atlantic Ave., York, Pa. 17404

[21] Appl. No.: 831,896

[22] Filed: Apr. 2, 1997

[51] Int. Cl.[6] ..... A63H 33/28

[52] U.S. Cl. ..... 446/15; 446/39; 446/44; 446/45; 473/582

[58] Field of Search ..... 446/15, 37–39, 446/44, 45, 217, 218; 473/582, 585, 586

[56] References Cited

U.S. PATENT DOCUMENTS

| | | | |
|---|---|---|---|
| 85,874 | 1/1869 | Tilden | 446/39 X |
| 3,002,314 | 10/1961 | Brottman | 446/15 |
| 4,031,656 | 6/1977 | Kupperman et al. | 446/217 |
| 4,195,615 | 4/1980 | Belokin | 473/582 X |
| 5,041,042 | 8/1991 | Stein | 446/15 |

*Primary Examiner*—Robert A. Hafer
*Assistant Examiner*—Jeffrey D. Carlson

[57] ABSTRACT

A toy bow-n-arrow bubble shooter system including a bow. The bow has a frame with a cylindrical member centrally interconnected thereto and an elastomeric string. The cylindrical member has a channel therein and a plunger member positioned within the channel. The plunger member has an interior end capable of engaging the channel of the cylindrical member. The plunger has an exterior end with a handle capable of engaging the elastomeric string of the frame. Included are a plurality of head attachments. Each head attachment has a hub-like member with a plurality of blades fixedly attached thereto. Lastly, a plurality of arrows are provided. Each arrow has a shaft with an upper portion that has a bulb head. The bulb head of each arrow snap couples within the hub-like member. Each arrow, with one of the head attachments coupled thereto, is positioned within the cylindrical member of the bow and capable of being released therefrom by action of the plunger member thereon.

1 Claim, 4 Drawing Sheets

TOY BOW-IN-ARROW BUBBLE SHOOTER SYSTEM

BACKGROUND OF THE INVENTION

1. Field of the Invention

The present invention relates to a toy bow-n-arrow bubble shooter system and more particularly pertains to providing a toy that has a head attachment for releasing a trail of bubbles as the arrow is catapulted through the air.

2. Description of the Prior Art

The use of a bubble blower is known in the prior art. More specifically, Bubble blowers heretofore devised and utilized for the purpose of making bubbles are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,304,085 to Novak discloses a toy bubble kit. U.S. Pat. No. 5,183,428 to Lin discloses a bubble blowing toy. U.S. Pat. No. 5,247,920 to Harbin discloses a toy bow. U.S. Pat. Des. 337,796 to Sutyak discloses a toy archery set. U.S. Pat. No. 5,135,422 to Bowen discloses a bubble wand. Lastly, U.S. Pat. No. 4,334,383 to Melotti discloses a water sprinkling toy pistol with bubble-blowing ring.

While these devices fulfill their respective, particular objectives and requirements, the aforementioned patents do not describe toy bow-n-arrow bubble shooter system that allows a bow-n-arrow to generate a trail of bubbles by having a head attachment with holes to be catapulted through the air after having been placed in a soap solution.

In this respect, the Toy bow-n-arrow bubble shooter system according to the present invention substantially departs from the conventional concepts and designs of the prior art, and in doing so provides an apparatus primarily developed for the purpose of providing a toy that has a head attachment for releasing a trail of bubbles as the arrow is catapulted through the air.

Therefore, it can be appreciated that there exists a continuing need for a new and improved toy bow-n-arrow bubble shooter system which can be used for providing a toy that has a head attachment for releasing a trail of bubbles as the arrow is catapulted through the air. In this regard, the present invention substantially fulfills this need.

SUMMARY OF THE INVENTION

In view of the foregoing disadvantages inherent in the known types of bubble blowers now present in the prior art, the present invention provides an improved toy bow-n-arrow bubble shooter system. As such, the general purpose of the present invention, which will be described subsequently in greater detail, is to provide a new and improved toy bow-n-arrow bubble shooter system and method which has all the advantages of the prior art and none of the disadvantages.

To attain this, the present invention essentially comprises a bow. The bow has a cylindrical member centrally interconnected thereto and an elastomeric string. The frame has a first end and a second end with the elastomeric string coupled between the first and second end. The cylindrical member has a channel therein and a plunger member positioned within the channel. The plunger member has an interior end capable of engaging the channel of the cylindrical member. The plunger having an exterior end with a handle. The handle engages the elastomeric string of the frame. The plunger member capable of being partially pulled out of the cylindrical member by pulling the handle axially away from the cylindrical member. The plunger member is capable of being pushed into the cylindrical by the action of the elastomeric string on the handle. Also, a plurality of head attachments are included. Each head attachment has a hub-like member with an opening therethrough. Each head attachment has a plurality of blades fixedly attached. Each blade of each head attachment has a plurality of openings for passage of air through and between each blade. Each blade of the plurality of head attachments projects angularly from the hub-like member. Each blade is dipped into a tray holding a soap solution for allowing the adhesion of a portion of the solution onto the blades of each head attachment. Lastly, a plurality of arrows are provided. Each arrow has a shaft with an upper portion and a bottom portion. The upper portion of each arrow has a bulb head attached thereto by a neck member. The shaft has a set of fins attached adjacent the bottom portion. The bulb head of each arrow is capable of snap coupling within the opening of the hub-like member. Each head attachment is capable of rotating freely about the bulb head when coupled. Each arrow, with one of the head attachments coupled thereto, is positionable within the cylindrical member of the bow. Each arrow is released from within the cylindrical member, when the plunger member is pushed into the cylindrical member by the force of the elastomeric string, for engaging the applicable arrow. Each arrow, when released from within the cylindrical member, is capable of allowing the head attachment to release the attached soap solution for the formation of a trail of bubbles as the arrow moves through the air.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toy bow-n-arrow bubble shooter system which has all of the advantages of the prior art bubble blowers and none of the disadvantages.

It is another object of the present invention to provide a new and improved toy bow-n-arrow bubble shooter system which may be easily and efficiently manufactured and marketed.

It is further object of the present invention to provide a new and improved toy bow-n-arrow bubble shooter system which is of durable and reliable constructions.

An even further object of the present invention is to provide a new and improved toy bow-n-arrow bubble shooter system which is susceptible of a low cost of manufacture with regard to both materials and labor, and which accordingly is then susceptible of low prices of sale to the consuming public, thereby making such toy bow-n-arrow bubble shooter system economically available to the buying public.

Even still another object of the present invention is to provide a toy bow-n-arrow bubble shooter system for providing a toy that has a head attachment for releasing a trail of bubbles as the arrow is catapulted through the air.

Lastly, it is an object of the present invention to provide a new and improved toy bow-n-arrow bubble shooter system including a bow. The bow has a frame with a cylindrical member centrally interconnected thereto and an elastomeric string. The cylindrical member has a channel therein and a plunger member positioned within the channel. The plunger member has an interior end capable of engaging the channel of the cylindrical member. The plunger has an exterior end with a handle capable of engaging the elastomeric string of the frame. Included are a plurality of head attachments. Each head attachment has a hub-like member with a plurality of blades fixedly attached thereto. Lastly, a plurality of arrows are provided. Each arrow has a shaft with an upper portion that has a bulb head. The bulb head of each arrow snap couples within the hub-like member. Each arrow, with one of the head attachments coupled thereto, is positioned within the cylindrical member of the bow and capable of being released therefrom by action of the plunger member thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
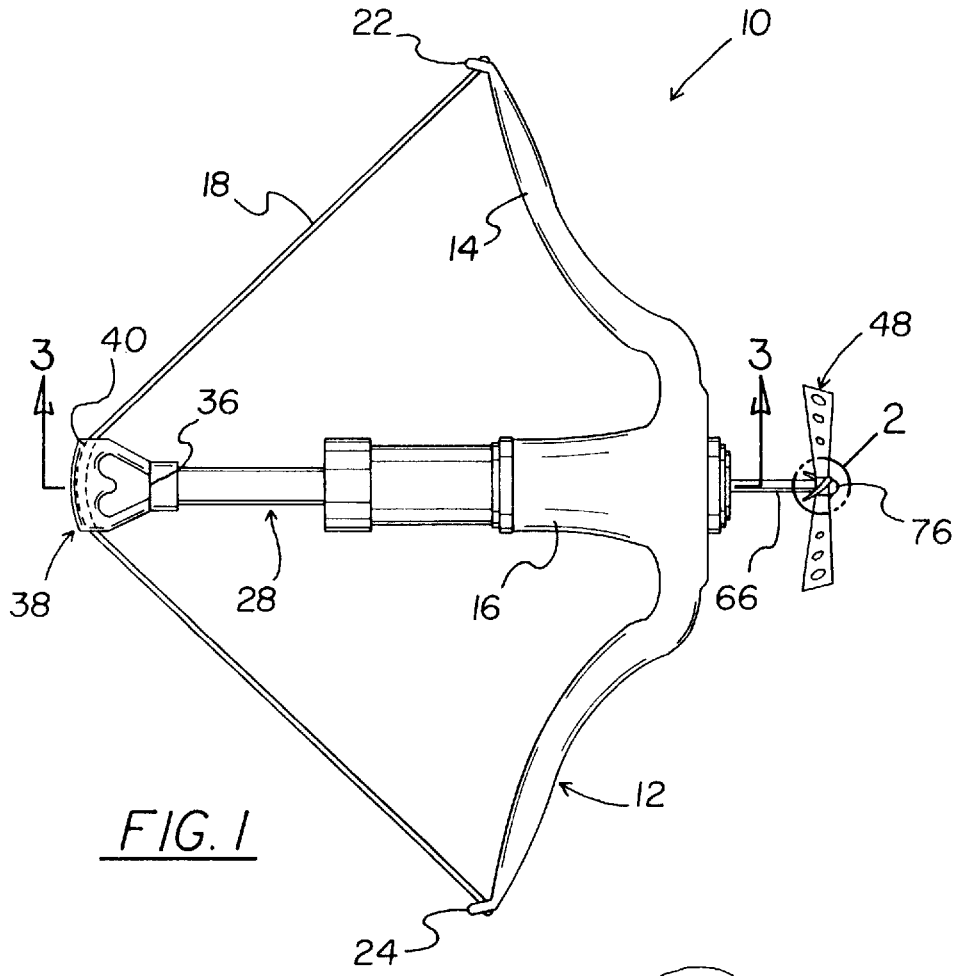
FIG. 1 is a perspective view of the preferred embodiment of the toy bow-n-arrow bubble shooter system constructed in accordance with the principles of the present invention.

With reference now to the drawings, and in particular to FIG. 1 thereof, the preferred embodiment of the new and improved toy bow-n-arrow bubble shooter system embodying the principles and concepts of the present invention and generally designated by the reference numeral 10 will be described.

The present invention, the Toy bow-n-arrow bubble shooter system 10 is comprised of a plurality of components. Such components in their broadest context include a bow, a head attachments, arrows and a tray of soap solution. Such components are individually configured and correlated with respect to each other so as to attain the desired objective.

Figure 3:
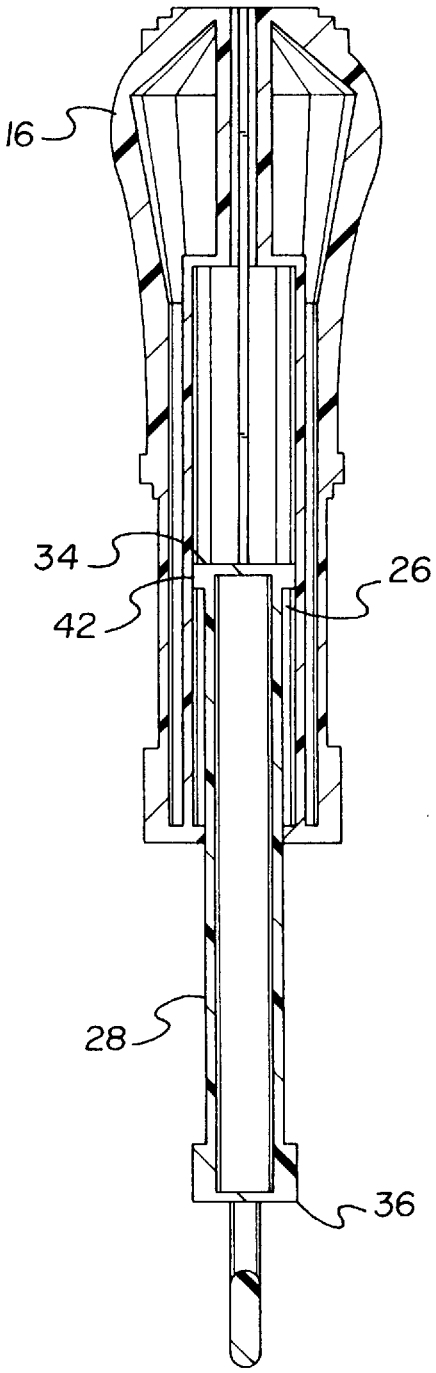
FIG. 3 is a cross-sectional view of the present invention taken along line 3—3 of FIG. 1.

Specifically, the present invention includes a bow 12. The bow has a frame 14 with a cylindrical member 16 centrally interconnected thereto and an elastomeric string 18. The frame, as shown in FIG. 1, has a first end 22 and a second end 24, with the elastomeric string coupled between the first and second end. The elastomeric string is a rubber band that has less tension than normally associated with a sporting bow. The cylindrical member having a channel 26 therein and a plunger member 28 positioned within the channel. FIG. 3 shown, the plunger member having an interior end 34 that is capable of engaging the channel of the cylindrical member. FIG. 1 shows, the plunger having an exterior end 36 with a handle 38. The handle has a notch 40 that is capable of engaging the elastomeric string of the frame.

Also, the plunger member 28 is capable of being partially pulled out of the cylindrical member by pulling the handle axially away from the cylindrical member. The plunger member is capable of being pushed into the cylindrical by the action of the elastomeric string on the handle. The movement of the plunger within the cylindrical member is controlled at the handle. A user would pull back on the handle and engage the elastomeric string simultaneously. The user then releases the handle and the elastomeric string, applying a spring like force, pushes the plunger member down into the cylindrical member. The plunger member has a stop notch 42 that prevents it from completely coming out of the cylindrical member.

Figure 2:
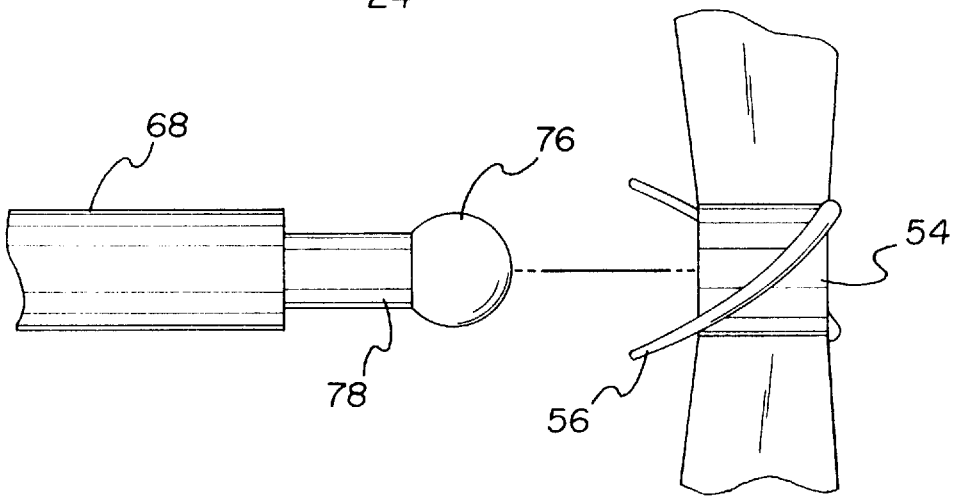
FIG. 2 is an enlarged sectional view taken along position 2 of FIG. 1.
Figure 5:
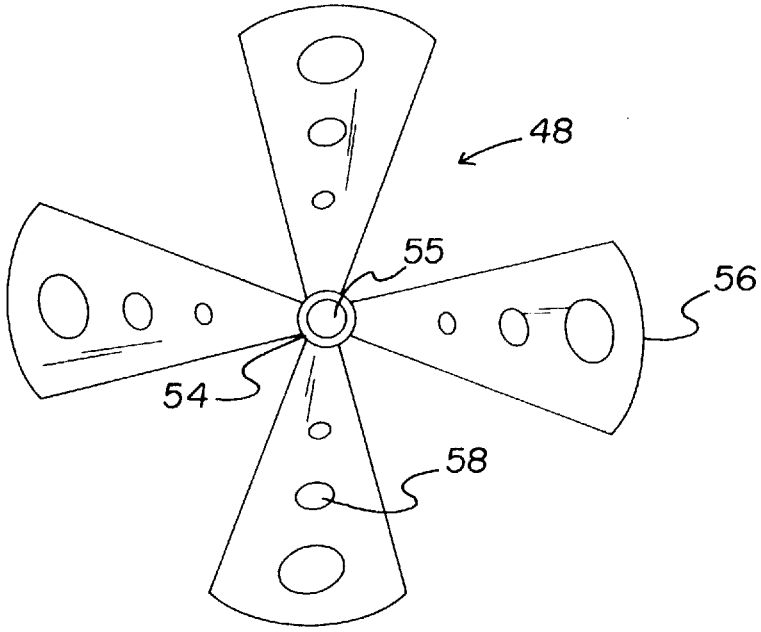
FIG. 5 is a frontal view of the bubble fan of the present invention.
Figure 6:
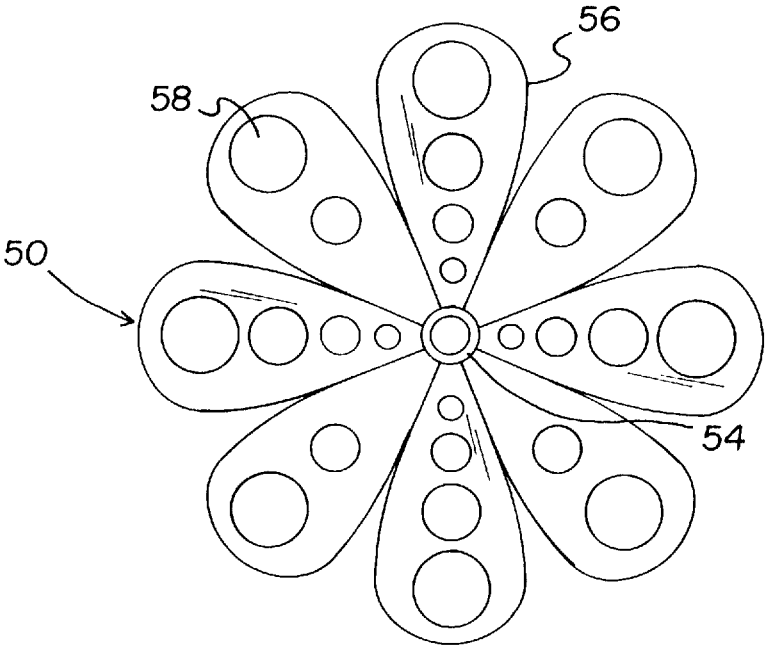
FIG. 6 is a frontal view of the bubble spinner of the present invention.
Figure 7:
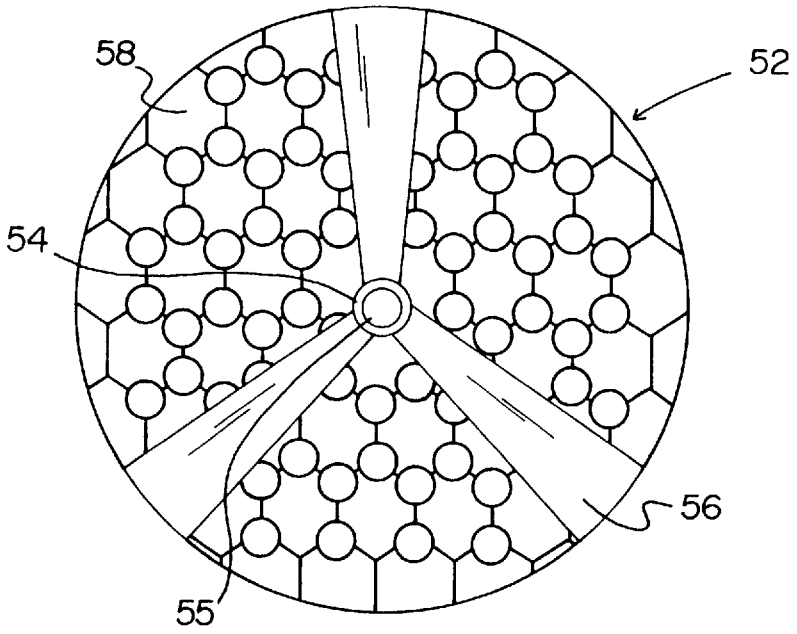
FIG. 7 is a frontal view of the honeycomb spinner of the present invention.
Figure 8:
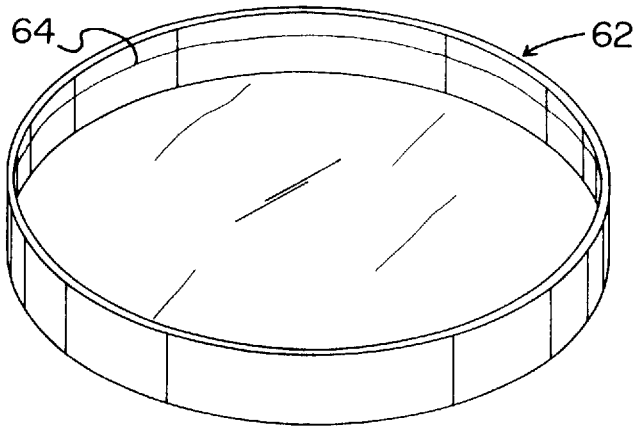
FIG. 8 is an isometric view of the tray with the soap solution of the present invention.

As best illustrated in FIGS. 5, 6 and 7, a plurality of head attachments 48, 50, and 52 are included. Each head attachment has a hub-like member 54, as depicted in FIG. 2. Each hub-like member has an opening 55. Each head attachment has a plurality of blades 56 fixedly attached. Each blade of each head attachment has a plurality of openings 58 for passage of air through and between each blade. Each blade of the plurality of head attachments projects angularly from the hub-like member. Each blade has the same general function. Blade 48 is called a bubble fan. Blade 50 is called a bubble spinner. Blade 52 is called a honeycomb spinner. Each blade is dipped into a tray 62 holding a soap solution 64 for allowing the adhesion of a portion of the solution onto the blades of each head attachment.

Figure 4:
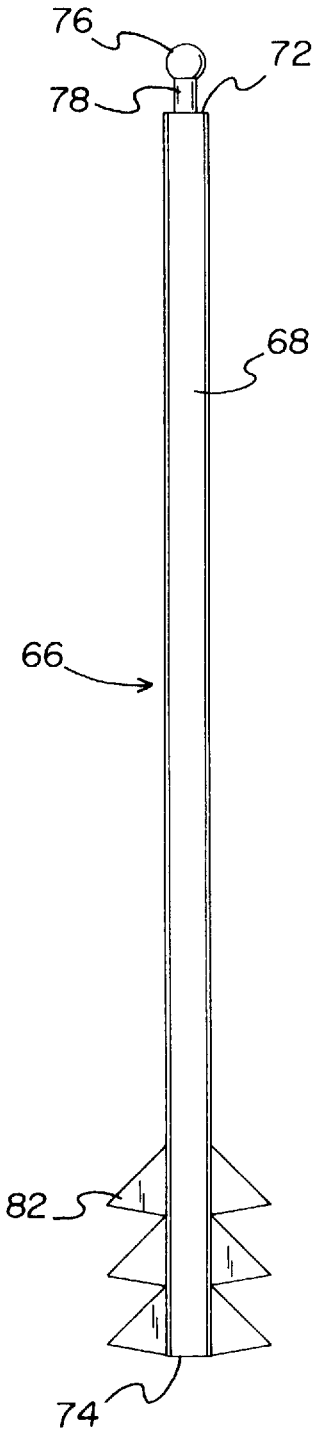
FIG. 4 is a side elevational view of an arrow of the present invention.

Additionally, a plurality of arrows 66 are included. One such arrow is shown in FIG. 4. Each arrow has a shaft 68 with an upper portion 72 and a bottom portion 74. The upper portion of each arrow has a bulb head 76 attached thereto by a neck member 78. The arrow is made of a light weight plastic. The shaft has a set of fins 82 attached and adjacent the bottom portion. The bulb head of each arrow is snap coupled within the opening of the hub-like member 54, as seen in FIG. 1. Each head attachment is capable of rotating freely about the bulb head when coupled. Each arrow, with one of the head attachments coupled thereto, is positioned within the cylindrical member 16 of the bow 12.

Lastly, when the arrow is positioned in the cylindrical member of the bow, the plunger is pulled back. The interior end of the plunger member engages the bottom portion of the arrow. Each arrow, placed within the cylindrical member is released from within the cylindrical member when the plunger member is pushed into the cylindrical member by the force of the elastomeric string. Each arrow, when released from within the cylindrical member, is capable of allowing the head attachment to release the attached soap solution for the formation of a trail of bubbles as the arrow moves through the air.

The present invention toy bow-n-arrow bubble system is a toy bow-n-arrow set that shoots bubbles by way of various head attachment. The head attachments are interchangeable and snap onto the bulb head of the arrow. Once one of the head attachments is dipped into the soap solution and placed within the cylindrical member, it is shot into the air. Shooting the arrow, with the head attachment, releases a trail of bubbles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved toy bow-n-arrow bubble shooter system for releasing a trail of bubbles with the release of an arrow comprising in combination:

a bow having a frame with a cylindrical member centrally interconnected thereto and an elastomeric string, the frame having a first end and a second end with the elastomeric string being coupled between the first and second end, the cylindrical member having a channel therein and a plunger member positioned within the channel, the plunger member having an interior end capable of engaging the channel of the cylindrical member, the plunger having an exterior end with a handle, the handle being capable of engaging the elastomeric string of the frame, the plunger member capable of being partially pulled out of the cylindrical member by pulling the handle axially away from the cylindrical member, the plunger member capable of being pushed into the cylindrical member by the action of the elastomeric string on the handle, the plunger member having a stop notch for preventing it from dislodging from within the cylindrical member;

a plurality of head attachments with each head attachment having a hub-like member with an opening therethrough, each head attachment having a plurality of blades fixedly attached thereto, each blade of each head attachment having a plurality of openings, each opening of each blade allows the passage of air therethrough, each blade of the plurality of head attachments projecting angularly from the hub-like member, a tray holding a soap solution receives each blade and a portion of the solution adheres to the blades of each head attachment; and a plurality of arrows with each arrow having a shaft with an upper portion and a bottom portion, the upper portion of each arrow having a bulb head attached thereto by a neck member, the shaft having a set of fins attached adjacent the bottom portion thereof, the bulb head of each arrow capable of snap coupling within the opening of the hub-like member, each head attachment being capable of rotating freely about the bulb head when coupled thereto, each arrow being coupled with one of the head attachments and being positioned within the cylindrical member of the bow, each arrow being released from within the cylindrical member when the plunger member being pushed into the cylindrical member by the force of the elastomeric string for engaging the applicable arrow, each arrow when released from within the cylindrical member being capable of allowing the head attachment to release the attached soap solution for the formation of a trail of bubbles as the arrow moves through the air.

* * * * *

UNITED STATES PATENT AND TRADEMARK OFFICE

CERTIFICATE OF CORRECTION

PATENT NO. : 5,830,029

DATED : November 3, 1998

INVENTOR(S) : Richard Bryan Siegel

It is certified that error appears in the above-identified patent and that said Letters Patent is hereby corrected as shown below:

On the title page, item [54] and Column 1, Title, please delete:

TOY BOW-IN-ARROW BUBBLE SHOOTER SYSTEM and insert therefor:

--TOY BOW-N-ARROW BUBBLE SHOOTER SYSTEM--

Signed and Sealed this

Ninth Day of March, 1999

*Attest:*

*Attesting Officer*

Q. TODD DICKINSON

*Acting Commissioner of Patents and Trademarks*